United States Patent [19]

Sheehan et al.

[11] 4,214,839

[45] Jul. 29, 1980

[54] LOOSE LEAF BINDER

[75] Inventors: Robert F. Sheehan, Granby; Raymond T. Cassidy, Ashfield, both of Mass.

[73] Assignee: National Blank Book Company, Inc., Holyoke, Mass.

[21] Appl. No.: 958,024

[22] Filed: Nov. 6, 1978

[51] Int. Cl.[2] ..... B42F 3/04

[52] U.S. Cl. ..... 402/31; 402/38

[58] Field of Search ..... 402/31-33, 402/36-43

[56] References Cited

U.S. PATENT DOCUMENTS

| | | | |
|---|---|---|---|
| 1,927,802 | 9/1933 | McMillan | 402/36 |
| 3,132,649 | 5/1964 | Gits | 402/38 |

FOREIGN PATENT DOCUMENTS

| | | | |
|---|---|---|---|
| 824966 | 12/1959 | United Kingdom | 402/39 |

*Primary Examiner*—John McQuade

*Attorney, Agent, or Firm*—Chapin, Neal & Dempsey

[57] ABSTRACT

Loose leaf binder composed of an arcuate back panel, pivotable cover panels and a toggle ring mechanism which is affixed to the inner concave surface of the back panel. The toggle mechanism includes spaced leaf ring members each composed of a pair of mating sections pivotable with the toggle mechanism between open and closed positions. Each ring member is defined by rectilinear leg portions extending outwardly of the toggle mechanism, upwardly and inwardly extending arm portions and transversely extending arcuate rail portions supported by the arm portions of the ring in spaced relation to the arcuate back panel. Each of the arm portions has a unidirectional slope and with a corner of generous radius fairs together with each rail portion, enabling the loose leaf sheets held on the rings to be smoothly swung from one side to the other of the binder.

8 Claims, 5 Drawing Figures

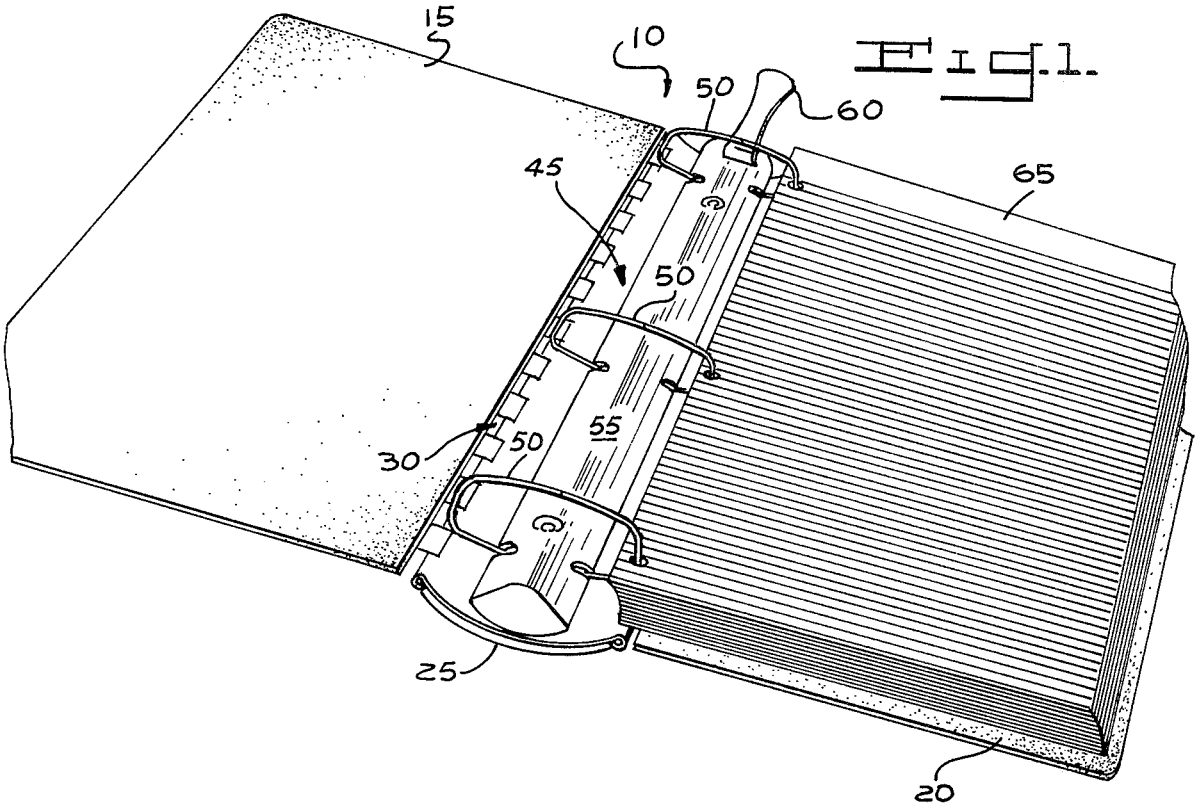
Fig. 1.
Fig. 2.
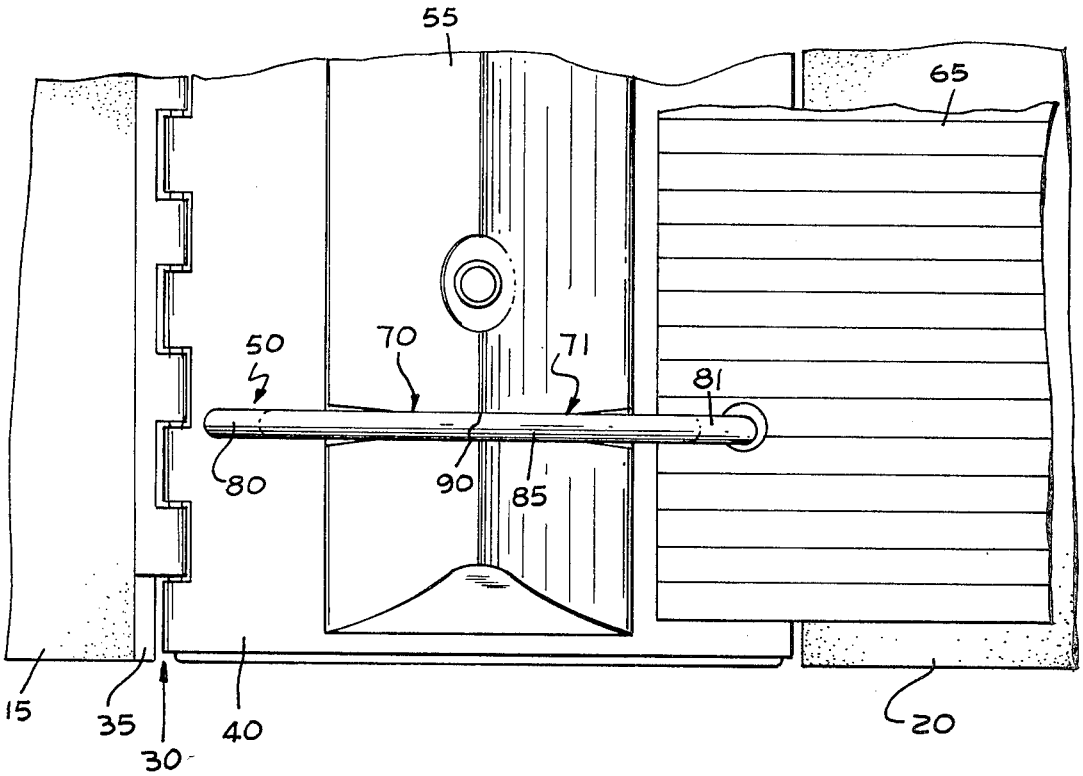

LOOSE LEAF BINDER

BACKGROUND

This invention relates generally to loose leaf binders and particularly to ring mechanisms employed therewith.

Loose leaf binders employing prior art ring mechanisms and particularly toggle ring mechanisms employing rings of generally circular shape, when filled to capacity with loose leaf sheets, often cause the sheets to wedge between the ring mechanism and the inside surface of the binder covers as they are opened and closed whereby there is a tendency for sheets to be torn. In addition, such a condition inhibits full closure of the binder covers.

One remedy for this paper jamming situation has been the utilization of sheet lifters in the form of plastic panels fitted onto the rings between the loose leaf sheets and the covers. Although such lifter panels help prevent jamming of the sheets, these lifters take up space which could otherwise be used for sheets and add to the cost of the binder.

Various ring configurations have been proposed as solutions to such paper jamming problems, but often the ring shapes present complex paths having one or more sharp corners along which the loose leaf sheets must be swung when leafing through the pages in the binder. In addition, specially designed rings usually require use of particular binder structures to accommodate each distinctive ring configuration.

Accordingly, it is a principal object of the present invention to provide a loose leaf binder which overcomes the deficiencies of the prior art.

It is another object of the present invention to provide a loose leaf binder wherein the risk of loose leaf sheets being caught between the ring mechanism and the covers thereof is minimized.

It is another object of the present invention to provide a loose leaf binder having non-circular ring structures which provide non-retrogressive paths of movement for loose leaf sheets held thereby.

SUMMARY OF THE INVENTION

These and other objects will become more readily apparent from the following detailed description wherein there is described a loose leaf binder employing rings of generally compound configuration including rectilinear and curvilinear portions comprising a pair of straight inwardly sloping side arms and an arcuate elongate top bar bridging the distance between the arms. The slope of the arms is unidirectional and merges smoothly with the arcuate rail whereby loose leaf sheets fitted on the rings will not be caught between the rings and the covers of the binder.

DESCRIPTION OF THE DRAWINGS

FIG. 1 is a perspective view of the loose leaf binder of the present invention in opened condition;

FIG. 2 is a top view on an enlarged scale of a portion of the binder;

DESCRIPTION OF THE PREFERRED EMBODIMENT

Figure 3:
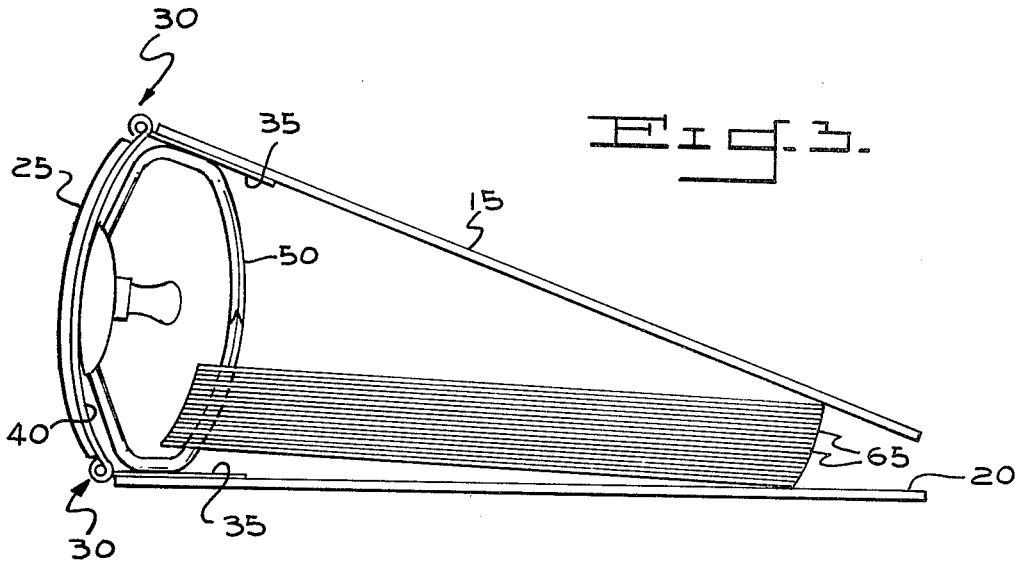
FIG. 3 is an elevational end view of the loose leaf binder in closed condition.

Referring to the drawings, the loose leaf binder of the present invention is shown generally at 10 and includes a pair of flat cover panels 15 and 20 hingedly connected to opposed longitudinal edges of a back panel 25. The cover and back panels may be formed of any suitable material such as molded plastic, plastic covered fiber board and the like. As shown, back panel 25 is generally cylindrical in shape and the cover panels are hinged to the back panel by piano type hinges as at 30 which include interdigitating plates 35 and 40 (FIG. 2). These plates also function to reinforce the mating edges of the cover and back panels. Although piano type hinges are shown for illustrative purposes, it will be recognized that other types of hinges such as heat sealed vinyl cladding may be employed if desired.

Binder 10 is provided with a toggle ring mechanism 45 including split rings 50 operated by a toggle plate mechanism (not shown) disposed within a housing plate 55. The particular toggle mechanism selected may be of any suitable one of the variety known in the art and upon movement of lever actuator 60 serves to snap the mating halves of rings 50 open and closed. Loose leaf liner sheets 65 may be fitted onto rings 50 and are removably retained in binder 10 in the conventional manner.

Figure 4:
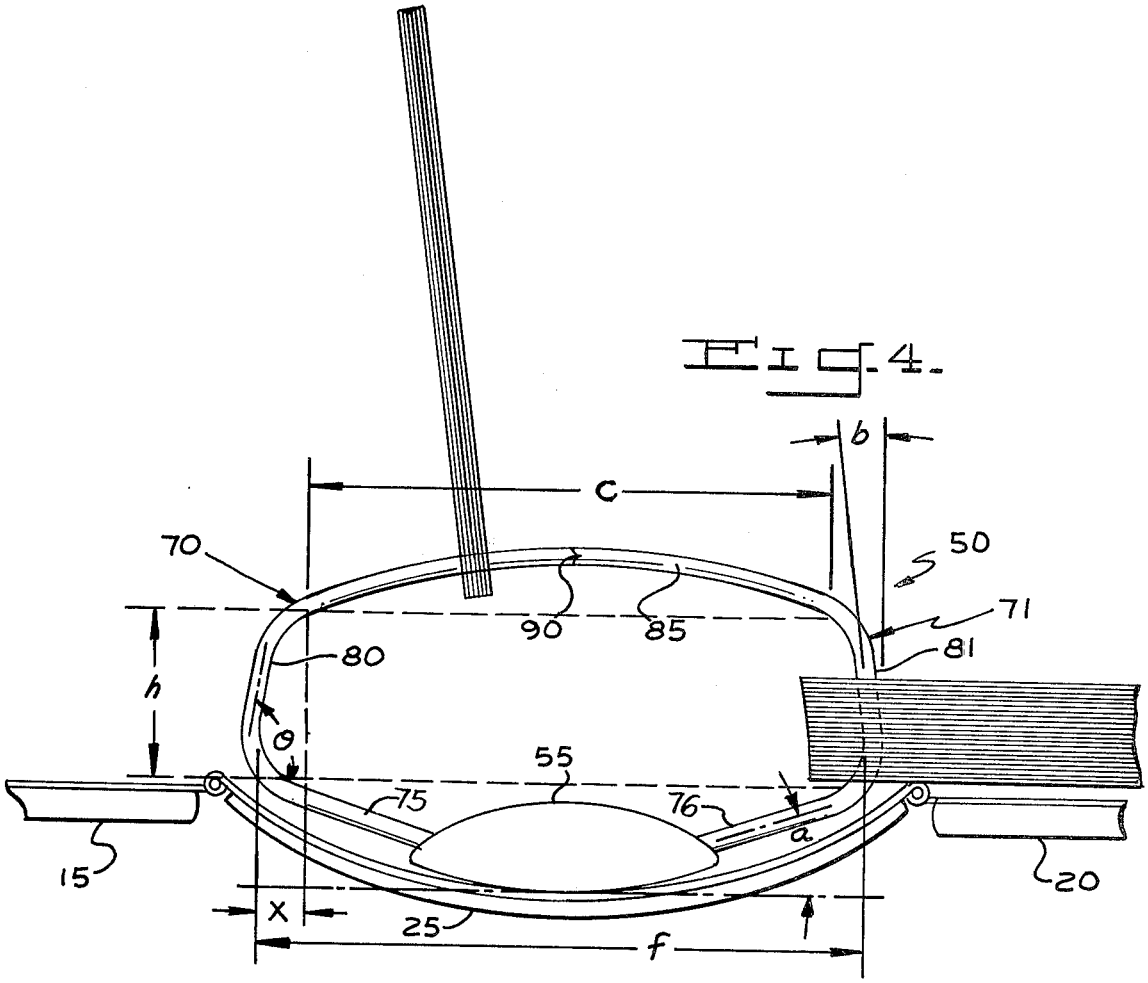
FIG. 4 is an elevational view of the binder portion shown in FIG. 2.

As best seen in FIG. 4, each of the rings 50 comprises a pair of mating ring segments 70 and 71 which may be fabricated of metal, plastic or the like and when closed define a non-circular loop having outer portions of generally arch-like configuration. The segments meet at junction 90 when the rings are closed. Each ring 50 is defined by a pair of rectilinear leg portions 75 and 76 extending outwardly and upwardly at an angle a from the housing 55 of toggle mechanism a distance such that the ends thereof are approximately adjacent to the hinges 30 which join the cover panels with the back panel 25, as best shown in FIG. 4. Angle a may be approximately 10°–15°. A corner radius smoothly blends each leg with a rectilinear upright arm portion 80 and 81 which slopes inwardly from its lower end portion to its upper end as illustrated in FIG. 4, where it merges about a corner radius with arcuate top rail 85. Side arms 80 and 81 define an angle b of approximately 8°–15° from the vertical when the binder is open on a horizontal surface. The rail 85 spans the distance from the upper ends of the arms 80 and 81 generally across the full width of the binder in closed condition as shown in FIG. 3. The radius of curvature of rail 85 is approximately one-half the width dimension of loose leaf sheets 65, i.e., about four inch radius for all 8×12 sheet binders.

The arcuate configuration of rail 85 enables loose leaf sheets to be freely swung from side-to-side in the binder along the path defined by the rail 85. The length of the rail 85 projected as a linear dimension c establishes the sheet capacity or "nominal size" of the binder. Thus, for example, in a 2, 3 or 4 inch binder, the length c of the rail for each binder would also measure approximately 2, 3 or 4 inches, respectively. While each different binder size will, of course, have a commensurate ring size, the binder cover and hinge members may be standardized at one size for different size binders.

Figure 5:
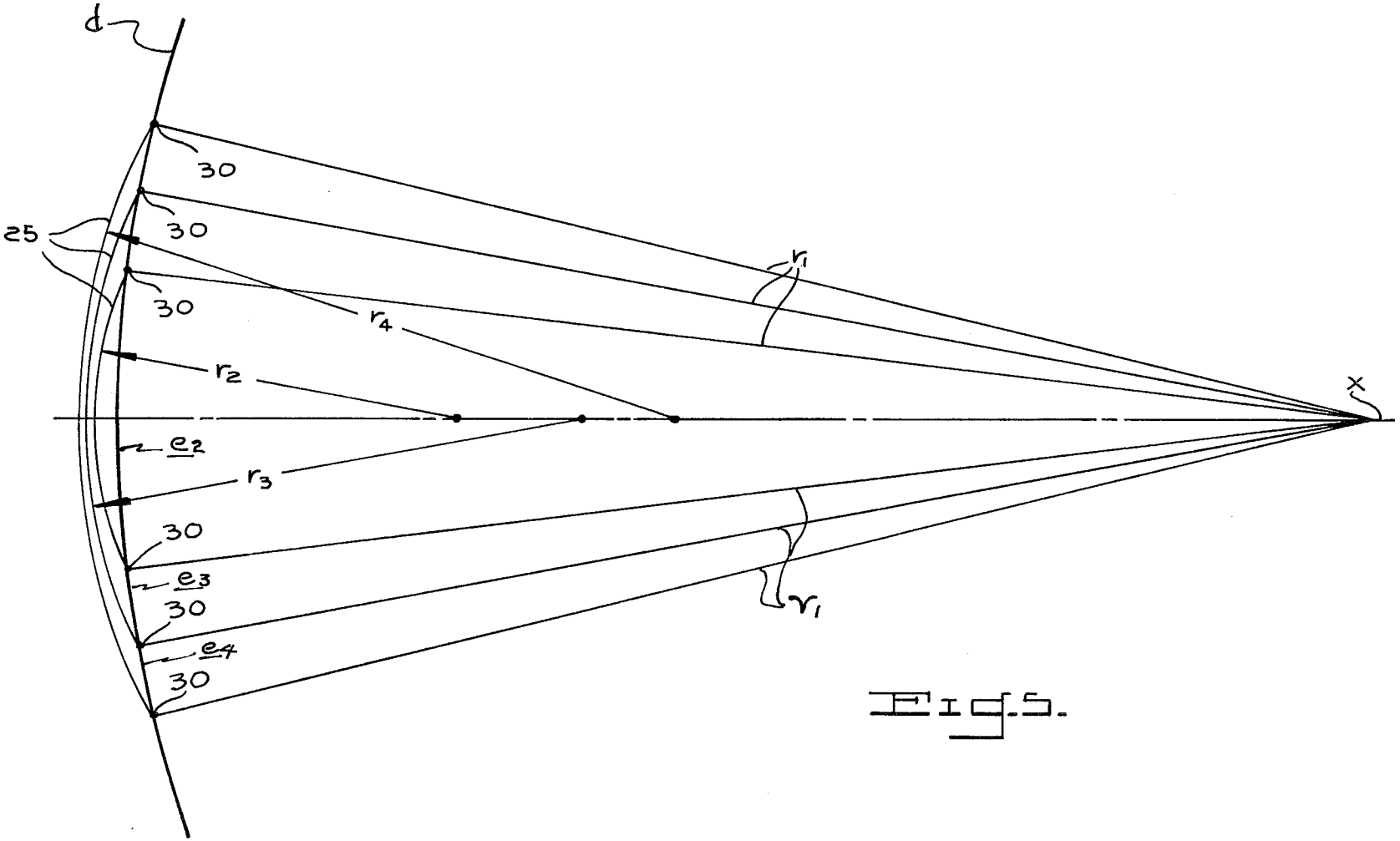
FIG. 5 is a schematic diagram illustrative of dimensional relationships of the binders embodying this invention.

As illustrated in FIG. 5, binders of various ring sizes utilize covers 15 and 20 of identical size. Thus for 8×12 sheet binders, the covers measured from hinge pin 30 will measure about 10½ inches. Accordingly, for a plurality of different size binders radii $r^1$ are of equal length and establish a circle or arc d which serves as a geometric reference for locating hinge pins 30 and also for establishing the arc length e of the different backing members 25 for various size binders. The arc lengths e, $e^2$, $e^3$ and $e^4$ empirically determined may be slightly more than one inch greater than the binder's ring capacity c. Based upon these geometrical relationships, the radius of curvature of each backing member may be established as shown at $r^2$, $r^3$ and $r^4$ with the center of curvature disposed along the perpendicular bisector of a chord which connects the ends of arc $e^2$.

In accordance with this invention, for rings 50, the following geometric relationship exists for each of the rings:

c=ring capacity (length of the chord spanning the points of intersection of the top rail and the arm portions)

$f=c+0.375''$ and h is a design variable and $\theta \cong 75°-82°$ based upon angle $b=8°-15°$.

With this mathematical relationship, a trapezoid is defined by the points of intersection of the sides c, f and h and the several dimensions of rings are readily ascertained for various size binders.

Regardless of sheet capacity of the binder the same size cover members may be used and readily assembled with proper size backing member 25 and corresponding ring size.

The non-circular configuration of the rings embodying this invention minimizes the incidence of sheets being caught between the ring and the binder cover when the binder is closed thereby causing improper closing of the binder and/or the tearing of the sheets. Such jamming is due primarily to the inability of sheets to move away from adjacent the lower edge of the ring without encountering a negative slope as is the case with circular rings and rings of various non-circular configuration.

By the present invention the risk of such sheet jamming is minimized. As best seen in FIG. 4, when the binder of the present invention is in an opened condition, the loose leaf sheets rest on the cover panels and the faired juncture of legs 75 and 76 and arms 80 and 81. When the binder is closed, the righthand cover is pivoted counterclockwise urging the sheets resting thereon upwardly and to the left, while the lefthand cover as it is pivoted in a clockwise direction urges the sheets resting thereon upwardly and to the right. When the binder is closed from this open position, the covers urge the sheets around the rings along arms 80, 81 and rail 85 in generally the same directions as traversed by the covers and the sheets encounter no reverse or negative slope. By thus providing only a unidirectional slope from the bottom to the top of the ring, it will be appreciated that the major cause of sheet jamming in loose leaf binders has been substantially overcome. Furthermore, as seen in FIG. 4, the slope of arms 80, 81 causes sheets 65 to be offset or echeloned with respect to one another, thereby enhancing the ease with which the sheets may be indexed and turned. As best seen in FIG. 3, the slope of arms 80, 81 causes the arms to be oriented in parallel contiguous relation to cover panels 15 and 20 when the binder is closed. Therefore, it will be appreciated that when the binder is empty or provided with an amount of paper less than or equal to that shown in FIG. 3, the covers contact the rings along the entire length of arms 80, 81 rather than at single points tangent to the rings as is the case with circular rings. Accordingly, indentation of the cover panels due to contact with the rings is reduced, whereby the useful life of the binder is greatly increased.

The arcuate configuration of rail 85 enables loose leaf sheets to be swung from side-to-side in the binder across rail 85.

It has been determined that binders of various capacities (2, 3 or 4 in.) may be assembled with cover-panels of a uniform width without a sacrifice of compactness in any of the binder sizes, the increase in the height (h) of the rings being accommodated largely by the increase in the radius of curvature of the back panel as illustrated in FIG. 5. Thus, as the size of the ring capacity is increased, a commensurate increase in the radius of curvature of the back panel will not result in any substantial change in the distance from the outer edges of the sheets to the corresponding edges of the cover panels. Generally, each different size circular ring binder has different size back and cover panels related to the diammetrical increase in the ring size.

Therefore, it will be seen that the loose leaf binder of the present invention lends itself to production in various sheet capacities with a minimum number of parts variations. Moreover, the binder overcomes many of the drawbacks of the prior art binders of similar type.

Having thus disclosed the invention, what is claimed is:

1. A loose leaf binder of the type having a back panel and a pair of cover panels hingedly connected to the opposite edges of said back panel and with a ring mechanism disposed within said back panel and including longitudinally spaced pairs of mating ring segments movable for opening and closing said ring mechanism, said ring segments when closed defining non-circular rings comprising: a pair of leg portions each extending outwardly and upwardly from said back panel to a point adjacent a separate one of said opposite edges of said back panel; a pair of arms of unidirectional slope extending upwardly and inwardly from the outer ends of each of said leg portions and an arcuate rail bridging the upper ends of said arms, a straight line disposed between points of connection of said rail and said arms defining the loose leaf holding capacity of said binder.

2. Loose leaf binder as set forth in claim 1 wherein each of said arms is rectilinear and fairs with said rail around a radius of curvature.

3. Loose leaf binder as set forth in claims 1 and further including a plurality of loose leaf sheets removably bound therein wherein the radius of curvature of said rail approximately equals one-half the width of said loose leaf sheets.

4. Loose leaf binder as set forth in claim 1 wherein for all binder capacities pairs of hinges are defined by interconnections between the back panel and cover panels and lie on a predetermined arc, the length of the radius of which is generally equal to the dimension of the cover panels measured from the hinge to the outer edge of said cover panel, said back panel having a radius of curvature substantially less than the radius of curvature defining said arc.

5. Loose leaf binder as set forth in claim 4 wherein the arms of said ring segments are generally parallel to the adjacent cover panel of said binder for line contact therewith when the binder is closed and empty.

6. Loose leaf binder as set forth in claim 4 wherein binders of different capacity and ring size have cover panels of the same dimension measured from the hinges to the outer cover panel edges and generally equal to the length of the radius of curvature of said arc whereby said radius of curvature of said arc is the same for different size binders and defines the location of pairs of hinges for said binders, the radius of curvature of back panels for said binders of different size being located on a perpendicular bisector of a chord extending between said pairs of hinges.

7. Loose leaf binder as set forth in claim 5 wherein said arms are inclined 8°–15° inwardly from the outer ends of said leg portions to the outer ends of said rail.

8. Loose leaf binder for loose leaf sheets having a back panel and cover panels hinged thereto and including at least one pair of separable ring segments defining when closed rings having lower leg portions extending upwardly and outwardly at an angle from said back panel, a pair of rectilinear arms each extending upwardly and sloping inwardly from the outer end of one of said leg portions, a transverse arcuate rail bridging the upper ends of said arms, a trapezoid being defined by the points of intersection of said rail, arms and leg portions.

* * * * *